United States Patent [19]

Schnabel

[11] 4,359,957

[45] Nov. 23, 1982

[54] TORPEDO AND OPERATING METHOD

[75] Inventor: J. William Schnabel, South Euclid, Ohio

[73] Assignee: TRW Inc., Cleveland, Ohio

[21] Appl. No.: 229,099

[22] Filed: Jan. 28, 1981

[51] Int. Cl.[3] ..... F42B 19/14; F42B 19/28

[52] U.S. Cl. ..... 114/20 A

[58] Field of Search ..... 114/20 A, 20 R, 67 A, 114/67 R

[56] References Cited

U.S. PATENT DOCUMENTS

| | | | |
|---|---|---|---|
| 1,688,761 | 10/1928 | Sperry | 114/20 A X |
| 2,589,225 | 3/1952 | Canfield | 114/20 R |
| 2,975,746 | 3/1961 | Corbett | 114/20 R |
| 3,048,137 | 8/1962 | Calehuff | 114/20 R |
| 3,069,527 | 12/1962 | Kovacik | 114/20 R X |
| 3,109,401 | 11/1963 | Karig | 114/20 A |
| 3,151,527 | 10/1964 | Hamlin | 91/506 |

FOREIGN PATENT DOCUMENTS

| | | | |
|---|---|---|---|
| 2454737 | 11/1974 | Fed. Rep. of Germany | 114/20 R |

*Primary Examiner*—David H. Brown
*Attorney, Agent, or Firm*—Yount & Tarolli

[57] ABSTRACT

To prevent the accumulation of a gas bubble at the inner end portion of a torpedo tube, exhaust gases are not discharged from an improved torpedo until after the torpedo has moved out of the torpedo tube. The improved torpedo includes a gas powered engine which rotates a hollow drive shaft to effect rotation of torpedo drive propellers in a known manner. During operation of the engine, there is a continuous flow of gas through the engine into the hollow drive shaft. When the torpedo is in the torpedo tube, gas is conducted from the hollow drive shaft through a manifold to a storage tank. Water which may accumulate in the hollow drive shaft is centrifugally slung outwardly against the side wall of the rotating drive shaft. Tubes extend through the water to a central portion of the drive shaft so that the gas can be conducted through the water in the shaft to the manifold and storage tank. When the torpedo has moved out of the torpedo tube, the pressure of the stored gas causes a valve to open and gas is discharged from the torpedo through the drive shaft and valve.

7 Claims, 8 Drawing Figures

TORPEDO AND OPERATING METHOD

BACKGROUND OF THE INVENTION

The present invention relates to a new and improved torpedo and a method by which engine exhaust gas is stored as the torpedo is discharged from a torpedo tube.

Known torpedos commonly have engines which are driven by a supply of gas under pressure, such as steam or gas generated from a liquid or solid monopropellant fuel. During operation of the engine, there is a continuous flow of the gas through the engine. The engine exhaust gas has previously been discharged through hollow drive shafts connected with torpedo drive propellers. Such a torpedo drive arrangement is disclosed in U.S. Pat. No. 3,151,527.

In addition, it has been suggested that the flow of gas which is discharged from a torpedo drive engine could be exhausted through an outer wall of the torpedo in the manner disclosed in U.S. Pat. No. 3,048,137. This patent contemplates that the exhaust gas will be conducted from the engine to an exhaust gas expansion chamber having porous or foraminous walls. The exhaust gas discharged from the expansion chamber flows through the foraminous wall into the water around the torpedo. The openings in the expansion chamber wall are sized so that exhaust gas passes through the expansion chamber wall at a low velocity and in minute bubbles.

A torpedo drive system in which the products of combustion flow through an annular space or tank is disclosed in U.S. Pat. No. 3,109,401. Exhaust gas flows from the storage space through a plurality of open holes or apertures formed in the housing or hull of the torpedo. Although there is a free flow of exhaust gas from the annular storage space through open holes, a pressure regulating and uni-directional flow valve is provided to maintain the combustion chamber at a desired pressure and to prevent an inflow of water when the combustion chamber is below the desired pressure.

During operation of the engines in these known torpedos, there is a continuous flow of exhaust gas from the torpedos. If an attempt was made to operate the torpedo drive engine when the torpedo is in a torpedo tube, the exhaust gases would accumulate at the inner end of the tube so that the torpedo drive propellers would be surrounded by exhaust gas. Since the drive propellers are designed to drive the torpedo under water, their performance is greatly impaired when the propellers are located in a bubble of exhaust gas.

The problem with accumulation of exhaust gases at one end of a torpedo tube during operation of the torpedo drive engine has been overcome in the past by using compressed air to discharge the torpedo from the torpedo tube. Thus with known torpedos having drive engines which continuously exhaust gas, compressed air has been used to blow the torpedo out of the torpedo tube. Once the torpedo has moved clear of the torpedo tube, the torpedo drive engines are started and exhaust gases are discharged from the torpedo. However, as the torpedo is discharged from the torpedo tube, a large bubble of compressed air escapes from the torpedo tube. This bubble of compressed air is relatively easy to detect.

Other known torpedos have had electric drive systems. With electric drive systems, there are no exhaust gases to be discharged from the torpedo. Therefore, the electric torpedo drive motors can be started in the torpedo tube. The torpedo swims out of the torpedo tube rather than being blown out of the torpedo tube by compressed air. Since compressed air is not used to discharge the torpedo from the torpedo tube, an easily detected bubble of compressed air is not discharged from the torpedo tube as an electrically driven torpedo is launched. While electrically driven torpedos have the advantage of being operable without compressed air to launch them from a torpedo tube, the electric drive systems with their associated batteries have limited performance capabilities. Due to these limited performance capabilities, it is often preferred to use torpedos having gas driven engines even though they must be discharged from a torpedo tube before the engines are started.

BRIEF SUMMARY OF THE PRESENT INVENTION

A torpedo constructed in accordance with the present invention is provided with a storage tank to hold exhaust gas during operation of a torpedo drive engine. This promotes efficient launching of the torpedo from a torpedo tube. Thus, if exhaust gas continuously flows from a torpedo as it starts to be discharged from a torpedo tube, the build up of exhaust gas at the inner end of the torpedo tube results in a bubble which reduces the effectiveness of torpedo drive propellers. By storing the engine exhaust gas in the torpedo until it is clear of the torpedo tube, the build up of gas in the torpedo tube is prevented to thereby promote efficient launching of the torpedo from the torpedo tube.

In providing for the storage of exhaust gas within the torpedo, the exhaust gas is discharged from the engine into a hollow drive shaft. The exhaust gases are blocked from exiting from the torpedo by a check valve. The exhaust gas is conducted from the hollow drive shaft through a manifold to a storage tank. When the gas pressure within the storage tank exceeds a predetermined pressure, a valve is opened and the exhaust gas is discharged directly through an orifice at the end of the torpedo drive shaft. The exhaust valve is biased closed with a force which is sufficient to enable exhaust gas to be accumulated in the storage tank until after the torpedo has been discharged from the torpedo tube and has moved clear of an associated vessel.

It is contemplated that cooling water may accumulate in the hollow torpedo drive shaft. To enable the exhaust gas to be removed from the drive shaft through the water, tubes extend into the central portion of the drive shaft. During rotation of the drive shaft, the water is pressed against the inside surface of the hollow shaft and exhaust gas can be conducted from the central portion through the water by the tubes.

Accordingly, it is an object of this invention to provide a new and improved method and apparatus for discharging torpedoes from torpedo tubes without accumulating exhaust gas in the torpedo tubes.

Another object of this invention is to provide a new and improved torpedo having a drive motor which discharges gas into a hollow drive shaft which is connected in fluid communication with a storage tank.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
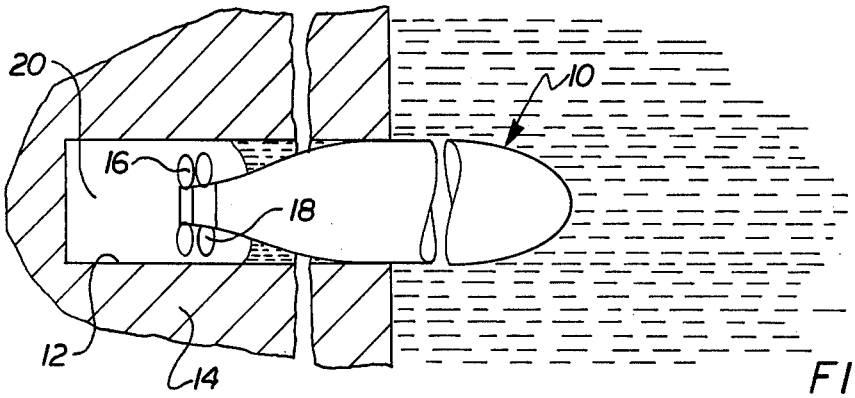
FIG. 1 (PRIOR ART)
FIG. 1 is a highly schematicized illustration of the manner in which compressed air is used to launch a known torpedo from a torpedo tube.

The launching of a known torpedo 10 from a torpedo tube 12 in a submarine or other vessel 14 is illustrated schematically in FIG. 1. During operation of drive engine within the known torpedo 10, gas is exhausted from the rear of the torpedo. If the torpedo drive engine is started in the torpedo tube, the exhaust gas displaces water at the inner end of the torpedo tube 12 with the result that torpedo drive propellers 16 and 18 are located in a gas bubble at the inner end of the torpedo tube. Since the torpedo drive propellers 16 and 18 were designed to function in water, their performance is greatly impaired when they are within the gas bubble. Therefore, the torpedo 10 is discharged from the torpedo tube 12 by a body 20 of compressed air. After the torpedo 10 has been blown out of the torpedo tube 12 by the compressed air 20, the torpedo drive engines are started.

Figure 2:
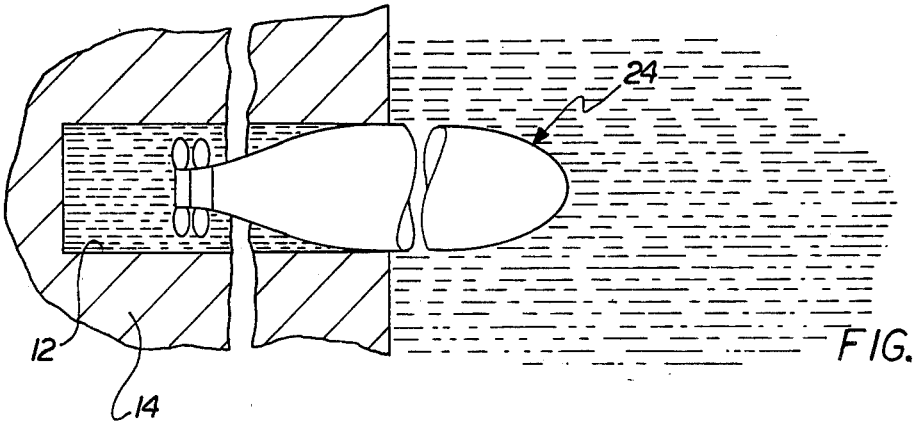
FIG. 2 is a schematic illustration of the manner in which a torpedo constructed in accordance with the present invention is discharged from a torpedo tube without exhausting gas from the torpedo.
Figure 3:
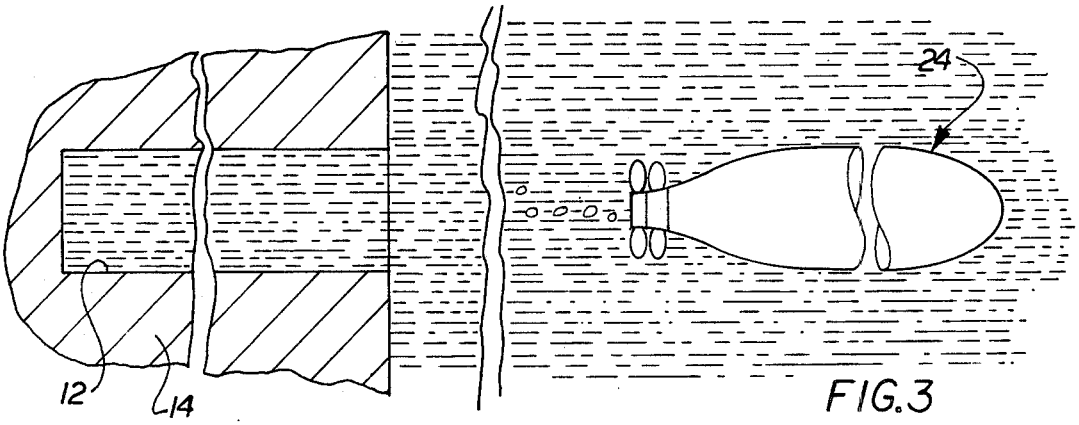
FIG. 3 is a schematic illustration of the torpedo of FIG. 2, illustrating the manner in which exhaust gas is discharged from the torpedo after it has moved out of the torpedo tube and is clear of an associated vessel.

In accordance with a feature of the present invention, an improved torpedo 24 (FIG. 2) does not discharge gas until the torpedo has moved clear of the torpedo tube 12 and vessel 14 in the manner illustrated in FIG. 3. By storing engine exhaust gas in the torpedo until the torpedo has moved clear of the torpedo tube, the displacement of water by torpedo exhaust gas is avoided. This tends to make the launching of the torpedo 24 difficult to detect compared to the launching of the torpedo 10 with its associated discharge of compressed air.

The torpedo 24 includes an engine 30 (FIG. 4) which is operated under the influence of gas pressure supplied from a source 32. The engine 30 is connected with a pair of counter rotating torpedo drive propellers 34 and 36 through a hollow drive shaft assembly 38. During operation of the engine 30 in the torpedo tube 12, engine exhaust gas is discharged into the hollow drive shaft assembly 38 and is blocked from flowing out of the torpedo by a valve 39. The exhaust gas is conducted from the hollow drive shaft assembly 38 to a storage tank 40 through a manifold assembly 42 and conduit 44. After the torpedo 24 has moved clear of the torpedo tube 12 in the manner shown in FIG. 3, the valve assembly 39 is operated automatically from the closed condition shown in FIG. 8 to an open condition to enable exhaust gas to be discharged from the rear of the torpedo through an outlet orifice 50.

The high pressure gas required to operate the torpedo drive engine 30 (FIG. 4) is supplied from the gas source 32. If steam is used as the high pressure gas, the gas source 32 would include a boiler. However, it is contemplated that a solid monopropellant fuel will be utilized to supply the high pressure gas in a known manner. Regardless of what type of gas source is used, there is a continuous flow of high pressure gas from the source 32 to the engine 30 during operation of the engine.

The torpedo drive engine 30 can have many different constructions. However, it is preferred to use a barrel engine of the wobble plate or cam type. The engine 30 includes a rotary distributor valve 54 (FIG. 5) which is connected in fluid communication with the gas source 32 through a gas pressure supply tube 56.

During operation of the engine 30, high pressure gas continuously flows through the tube 56 and is directed to certain individual expansion volumes comprised of piston and cylinder assemblies 60 by the valve 54. At the same time, a continuous flow of gas is exhausted from other individual piston and cylinder assemblies 60 to a central passage 64 formed in a hollow inner drive shaft 66.

The reciprocatory motions of pistons 70 (FIG. 5) in the piston and cylinder assemblies 60 are converted to rotational movement by a wobble plate or cam assembly 74. The swashplate assembly 74 includes a cam 76 which is fixedly connected with the hollow inner drive shaft 66. Rotation of the inner shaft 66 by the swashplate cam 76 is effective to rotate the torpedo drive propeller 36. The other torpedo drive propeller 34 is connected with a rotatable outer drive shaft 80 which is fixedly connected with the motor housing 82. The motor housing 82 and drive shaft 80 are rotatably supported by suitable bearings 86 and 88.

During operation of the engine 30, reaction forces cause the housing 82 and outer drive shaft 80 to rotate in one direction while the cam plate 76 and inner drive shaft 66 rotate in the opposite direction. This effects counter rotation of the torpedo drive propellers 34 and 36. The construction and mode of operation of the engine 30 is the same as is disclosed in U.S. Pat. No. 3,151,527 and will not be further described herein in order to avoid prolixity of description. However, it should be understood that other known engines could be used to effect counter rotation of the hollow torpedo propeller drive shafts 66 and 80 if desired. Specifically, an engine with a double lobed cam could be used to obtain two power strokes per revolution. Regardless of what type of engine 30 is selected, the engine would be operated under the influence of high pressure gas which is exhausted into the cylindrical passage 64 in the hollow drive shaft 66 during operation of the engine.

Figure 4:
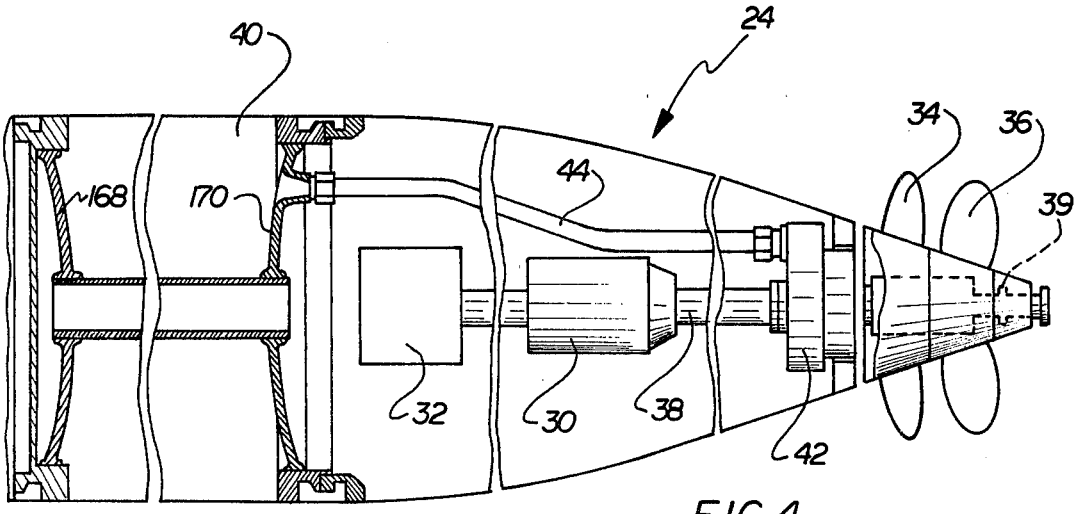
FIG. 4 is a fragmentary sectional view of a torpedo constructed in accordance with the present invention and illustrating the relationship between a source of gas under pressure, a gas operated engine which is connected with torpedo drive propellers by hollow drive shafts, an exhaust manifold which circumscribes the drive shafts and an exhaust gas storage tank.
Figures 5, 8:
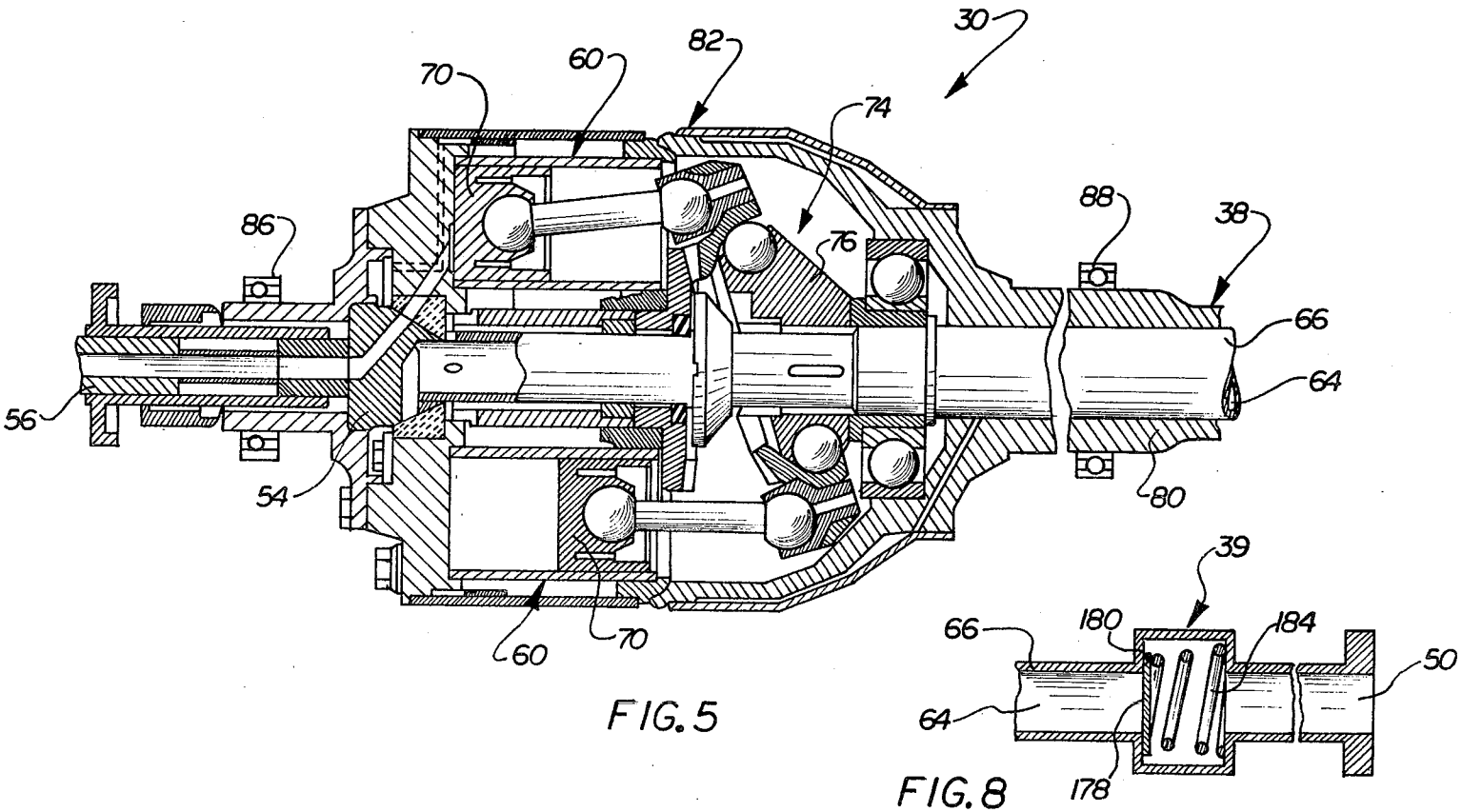
FIG. 5 is an enlarged fragmentary sectional view of the engine used in the torpedo of FIG. 4.
FIG. 8 is a fragmentary schematic illustration of a valve which controls the discharge of exhaust gas from the torpedo through an orifice at the end of a hollow drive shaft.

In accordance with one of the features of the present invention, the engine exhaust gas is conducted from the hollow inner drive shaft 66 (FIG. 5) to the storage tank 40 (FIG. 4). In conducting the exhaust gases from the drive shaft 66 to the storage tank 40, the exhaust gas is first transmitted from the rotating drive shaft assembly 38 to the stationary manifold assembly 42. The exhaust gas is then transferred from the manifold assembly to the conduit 44 leading to the storage tank 40.

In order to provide for the conduction of exhaust gas from the inner drive shaft to the conduit 44, the manifold assembly 42 includes a housing 94 (FIG. 6) which circumscribes the drive shaft 66 at a location between the engine 30 and propellers 34 and 36. Within the housing 94 is an annular inner chamber 98 which extends around and is connected in fluid communication with the interior of the hollow drive shaft 66. An annular outer manifold chamber 100 extends around the inner chamber 98 and is connected in fluid communication with both the inner manifold chamber 98 and the conduit 44.

Figure 7:
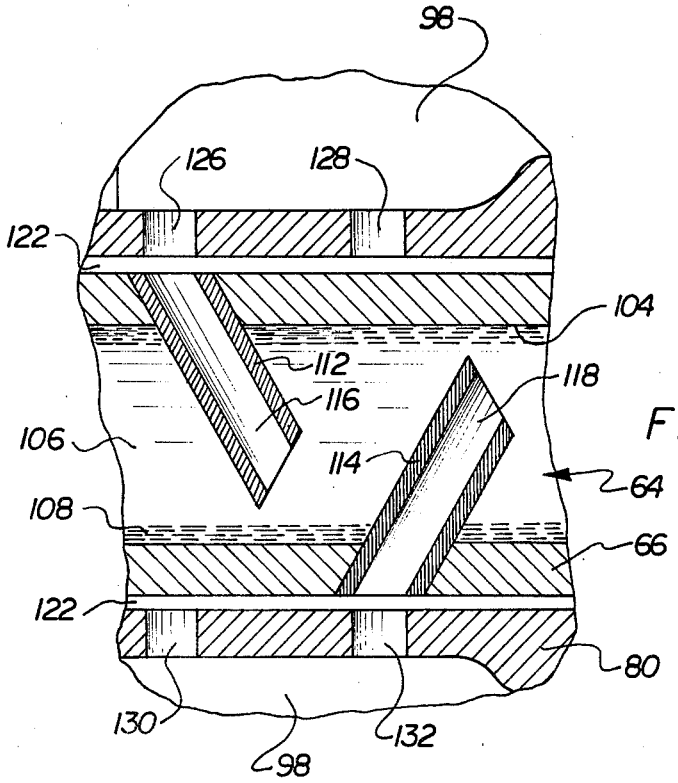
FIG. 7 is an enlarged fragmentary illustration of the manner in which exhaust gas is conducted through a body of water on the inside of the drive shaft to the manifold of FIG. 6.

It is contemplated that cooling water will accumulate in the passage 64 through the hollow drive shaft 66. During operation of the engine 30, this liquid is slung or urged radially outwardly under the influence of a centrifugal force as the drive shaft 66 rotates about its central axis and the central axis of the engine 30. This causes the liquid to accumulate in an annular body against the cylindrical inner side surface 104 (see FIGS. 6 and 7) of the hollow drive shaft 66. This results in the central portion 106 (see FIG. 7) of the passage 64 being surrounded by a cylindrical body 108 of liquid.

In order to enable exhaust gas to flow from the central portion 106 of the rotating drive shaft 66 to the storage chamber 40, a plurality of cylindrical tubes 112 and 114 extend from the side wall of the hollow drive shaft 66 into the central portion of the passage 64. This enables exhaust gas to flow through passages 116 and 118 in the tubes 112 and 114 without conducting water from the central passage 64 along with the exhaust gas.

After passing through the side wall of the hollow inner drive shaft 66, the exhaust gas enters an annular chamber 122 (FIG. 7) which is disposed between the inner and outer drive shafts 66 and 80. The exhaust gas then flows through radially extending openings 126, 128, 130 and 132 in the wall of the outer drive shaft 80 to the annular manifold chamber 98. Thus, during operation of the engine 30, exhaust gas is ported from the central portion 106 of the inner rotating drive shaft 66 through the tubes 112 and 114 and through the openings 126–132 in the rotating outer drive shaft 80 to the manifold chamber 98 without conducting liquid into the manifold chamber.

The coaxial inner and outer drive shafts 66 and 80 are supported for counter rotation relative to a circular end wall 138 (see FIG. 6) by a bearing assembly 140. A second bearing assembly 144 supports the manifold housing 94 on the outer drive shaft 80.

Figure 6:
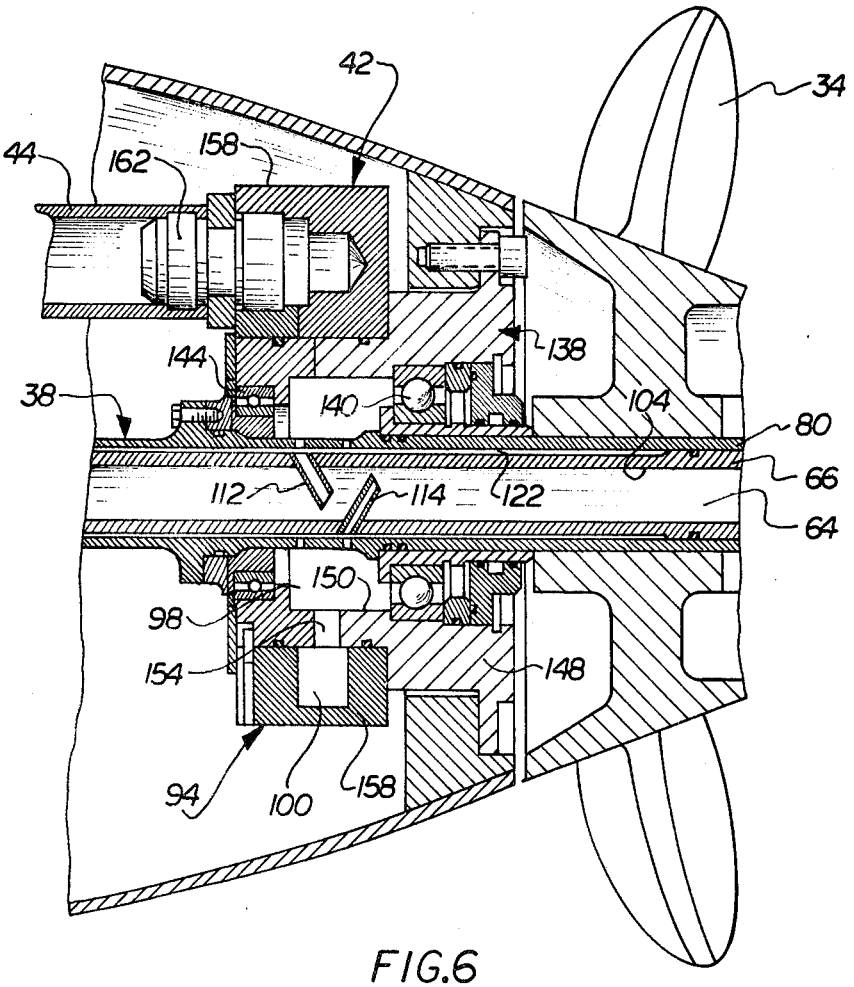
FIG. 6 is an enlarged fragmentary sectional view illustrating the relationship between the exhaust manifold and the hollow drive shafts.

The manifold housing 94 includes a generally cylindrical main or base wall 148 which forms part of the end wall 138 and has a cylindrical inner surface 150 which defines the radially outer extent of the annular manifold chamber 98. Passages 154 extend radially outwardly through the housing base wall 148 to the annular outer manifold chamber 100 which is partially defined by a housing ring 158. The housing ring 158 is connected with the exhaust gas conduit 44 by a fitting 162 (FIG. 6). It should be understood that suitable seals are provided in the end wall 138 to prevent sea water from entering the torpedo. In addition, suitable seals are provided between the counter rotating drive shafts 66 and 80 to prevent seawater from leaking into the annular chamber 122.

The exhaust gas storage tank 40 (see FIG. 4) is disposed in the torpedo body at a location ahead of and in axial alignment with the gas source 32 and engine 30. Thus, the conduit 44 extends from the manifold 42 forwardly to the exhaust gas storage tank 40. The manifold 42 is located at the rear of the torpedo 24, forwardly of the propellers 34 and 36 and rearwardly of the engine 30. The exhaust gas storage tank 40 is defined by a pair of circular end walls 168 and 170 which are disposed in a coaxial relationship with the motor 30, manifold 42 and propellers 34 and 36.

The storage tank 40 has a volume sufficient to enable gas discharged from the engine 30 to be accumulated in the storage tank 40 until after the torpedo 24 has moved clear of the torpedo tube 12 (see FIG. 3). In addition, the tank 40 has a storage capacity sufficient to enable to torpedo 24 to move for a substantial distance through the water after it has been discharged from the torpedo tube 12, before exhaust gases are discharged from the rear end of the torpedo. By providing sufficient storage capacity in the tank 40 to enable the torpedo 24 to move for a substantial distance through the water before exhaust gases are discharged from the torpedo, it is believed that it will be more difficult to detect the vessel from which the torpedo is launched.

The valve assembly 39 (FIG. 8) includes a circular valve member 178. The valve member 178 is biased toward a closed position against a valve seat 180. The closed valve member 178 blocks the flow of gas through the passage 64 in the inner drive shaft 66. In addition, the closed exhaust valve member 178 blocks a flow of seawater to the engine 30 through the drive shaft 66.

After the torpedo has moved for a substantial distance away from the vessel from which it is launched, the pressure of the exhaust gas discharged from the engine 30 is sufficient to cause the valve member 178 to move rightwardly (as viewed in FIG. 8), against the influence of a biasing spring 184, to an open condition. When the valve member 178 is in the open condition, gases discharged from the engine 30 flow through the inner drive shaft 66 and valve assembly 39 to the orifice 50 at the rear or stern end of the torpedo 24. The exhaust gases are then discharged from the torpedo through the orifice 50.

Once the valve 39 has been opened, the storage tank 40 and engine 30 are effectively connected in parallel with the orifice 50. Therefore, exhaust gas discharged from the engine will flow directly through the valve 39 and orifice 50 without entering the storage tank 40. However, prior to opening of the exhaust valve 48, all of the gas discharged from the engine 30 is transmitted to the storage tank 40. Although a particular type of exhaust valve assembly 39 has been indicated schematically in FIG. 8, it is contemplated that many different known types of exhaust valves could be used.

In view of the foregoing description it is apparent that a torpedo 24 constructed in accordance with the present invention is provided with a storage tank 40 to hold exhaust gas during operation of a torpedo drive engine 30 while the torpedo is in a torpedo tube 12. This promotes efficient launching of the torpedo 24 from the torpedo tube 12. By storing the engine exhaust gas in the tank 40 until the torpedo 24 is clear of the torpedo tube 12, a build up of gas in the torpedo tube is prevented to thereby promote efficient launching of the torpedo 24.

In providing for the storage of exhaust gas within the torpedo 24, the exhaust gas is discharged from the engine 30 into the hollow drive shaft 66. The exhaust gas is conducted from the hollow drive shaft 66 through the manifold 42 to the storage tank 40. When the gas pressure within the storage tank 40 exceeds a predetermined pressure, the valve 39 is opened and the exhaust gas is discharged through an orifice 50 at the end of the torpedo drive shaft 66. The exhaust valve 39 is biased closed with a force which is sufficient to enable exhaust gas to be accumulated in the storage tank 40 until after the torpedo has been discharged from the torpedo tube 12 and has moved clear of an associated vessel.

It is contemplated that cooling water will accumulate in the hollow torpedo drive shaft 66. To enable the exhaust gas to be removed from the drive shaft 66, tubes 112 and 114 extend into the central portion 106 of the drive shaft. During rotation of the drive shaft 66, the cooling water 108 is pressed against the inside surface 104 of the hollow shaft 66 and exhaust gas can be conducted from the central portion through the water by the tubes.

I claim:

1. A method of discharging a torpedo from a torpedo tube, said method comprising the steps of providing gas under pressure in the torpedo while the torpedo is in the torpedo tube, conducting the gas to an engine within the torpedo, operating the engine under the influence of the gas to move a torpedo drive element in water in the torpedo tube, moving the torpedo out of the torpedo tube under the influence of forces applied against the water in the torpedo tube by the drive element, continuously flowing gas through and discharging gas from the engine during operation of the engine and movement of the torpedo out of the torpedo tube, storing gas discharged from the engine in the torpedo during movement of the torpedo out of the torpedo tube, and initiating a discharge of gas from the torpedo only after the torpedo has moved completely out of the torpedo tube.

2. A method as set forth in claim 1 wherein said step of operating the engine includes the step of rotating a hollow drive shaft connected with the torpedo drive element, said step of discharging gas from the engine including the step of discharging gas from the engine into the hollow drive shaft, said step of storing gas discharged from the engine including the step of conducting gas from the hollow drive shaft to a storage tank in the torpedo, said step of initiating a discharge of gas from the torpedo including the step of flowing gas from the drive shaft through an orifice connected in fluid communication with the exterior of the torpedo and the interior of the drive shaft.

3. A method as set forth in claim 1 wherein said step of operating the engine includes the steps of rotating a hollow drive shaft which is connected with the torpedo drive element and contains a body of water, moving the body of water outwardly against an inner side surface of the drive shaft under the influence of centrifugal force as the drive shaft is rotated by the engine to thereby leave a central portion of the hollow drive shaft free of water, said step of storing gas including the step of conducting gas from the central portion of the hollow drive shaft through the body of water in the drive shaft to a storage tank in the torpedo.

4. A method as set forth in claim 1 wherein said step of operating the engine includes the step of rotating a hollow drive shaft connected with the drive element and engine, said step of discharging gas from the engine includes the step of discharging gas into the hollow drive shaft, said step of storing gas including the step of conducting a flow of gas from the hollow drive shaft at a location between the engine and the drive element.

5. A torpedo comprising a source of gas under pressure, an engine operable under the influence of gas pressure and connected in fluid communication with said source of gas, drive means operable to apply force to water to move said torpedo through the water, a hollow rotatable drive shaft connected with said engine and said drive means, said engine being operable to discharge gas into and to rotate said drive shaft during operation of said drive means, tank means for holding gas, manifold means circumscribing said drive shaft and connected in fluid communication with said tank means for receiving a flow of gas from the interior of said drive shaft, orifice means connected in fluid communication with the interior of said drive shaft for conducting a flow of gas from said torpedo into the water, and valve means operable between a closed condition blocking gas flow through said orifice means and an open condition enabling gas to flow through said orifice means, said manifold means conducting a flow of gas from the interior of said drive shaft to said tank means during operation of said engine with said valve means in the closed condition.

6. A torpedo as set forth in claim 5 further including tube means extending into a central portion of said drive shaft and connected in fluid communication with said manifold means for enabling gas to flow from the central portion of said drive shaft through water urged against an inner side surface of said drive shaft by centrifugal force during rotation of said drive shaft.

7. A torpedo as set forth in claim 5 wherein said valve means includes means for maintaining said valve means in the closed condition during operation of said engine for a period of time sufficient to enable said drive means to move said torpedo out of a torpedo tube.

* * * * *